US005079775A

United States Patent [19]

Kaburaki

[11] Patent Number: 5,079,775

[45] Date of Patent: Jan. 14, 1992

[54] DIVING HELMET

[75] Inventor: Masahiko Kaburaki, Tokyo, Japan

[73] Assignee: Tohgun Kigyo Co., Ltd., Tokyo, Japan

[21] Appl. No.: 615,141

[22] Filed: Nov. 19, 1990

[30] Foreign Application Priority Data

Feb. 7, 1990 [JP] Japan ..... 2-10580[U]

[51] Int. Cl.[5] ..... B63C 11/06

[52] U.S. Cl. ..... 2/2.1 R; 128/200.29; 128/201.27

[58] Field of Search ..... 2/2.1 R, 410, 424, 425; 128/200.29, 201.27

[56] References Cited

U.S. PATENT DOCUMENTS

| | | | |
|---|---|---|---|
| 1,195,793 | 8/1916 | Dunn et al. | 128/201.27 |
| 1,209,224 | 12/1916 | Stelzner | 2/410 |
| 1,935,132 | 11/1933 | Scrimgeour | 2/2.1 R |
| 2,693,180 | 11/1954 | Galeazzi | 128/201.27 |
| 2,988,749 | 6/1961 | Crouzet | 2/424 |
| 3,172,126 | 3/1965 | Spano et al. | 2/2.1 R |
| 3,364,616 | 1/1968 | Speers | 2/2.1 R |
| 3,568,672 | 3/1971 | Cupp | 128/200.29 |
| 4,527,658 | 7/1985 | Payne | 128/200.29 |

OTHER PUBLICATIONS

Hartley's Undersea Walk, Copyright 1987, Created by Michael Hannau Enterprises, Inc.

*Primary Examiner*—Werner H. Schroeder
*Assistant Examiner*—Michael A. Neas
*Attorney, Agent, or Firm*—Zarley, McKee, Thomte, Voorhees & Sease

[57] ABSTRACT

A diving helmet comprises a head and a body-contacting portion which is provided under the head. The body-contacting portion comprises a chamber in which the inner wall has a plurality of exhaust guide holes and the outer wall has a plurality of exhaust holes. Excess air which is discharged with breathing of a user is discharged from the helmet into the water through the exhaust guide holes and the exhaust holes, thereby providing stable exhaustion without unexpected sound or vibration.

3 Claims, 3 Drawing Sheets

DIVING HELMET

BACKGROUND OF THE INVENTION

This invention relates to an easily usable diving helmet.

In a known diving helmet, a head and a body contacting portion are made of a heavy metal or synthetic resin with a relatively large thickness, thereby functioning as a weight. The face of the head comprises a transparent window and an exhaust tube is connected to the back of the head. Excess air which is fed into the helmet and discharged with breathing is discharged into the sea along the highest portion of the lower edge of the helmet. When the excess air is discharged from the diving helmet, it is discharged as large bubbles at a stroke, which results in generating a large sound and swinging the helmet. If the user is a beginner, it will allow him or her to feel uneasy. When he is bent forward to watch his feet at the bottom of the sea, the helmet which functions as a weight is pressed forward, thereby allowing him to fall down.

SUMMARY OF THE INVENTION

According to the present invention, there is provided a diving helmet which comprises a head in which the face comprises a transparent window, a body-contacting portion which is provided under said head, said head and said body-contacting portion being made of heavy metal or synthetic resin, an air-supply tube which is connected to the back of the head and an elongate chamber which is formed in said body-contacting portion, the inner wall of said elongate chamber having a plurality of exhaust guide holes, the outer wall thereof having a plurality of exhaust holes so that bubbles may be discharged into the water through said exhaust guide holes and said exhaust holes.

The air in the helmet is collected through a plurality of exhaust guide holes which are provided in the inner wall along the lower edge of the head, and guided to a plurality of relatively small exhaust holes of the back of the helmet through the chamber of the lower edge of the head. The air is transformed into small bubbles through each of the exhaust holes, thereby providing stable exhaustion and preventing unexpected sound or vibration.

BRIEF DESCRIPTION OF THE DRAWINGS

These and the other features and advantages of this invention will be apparent from the following description with respect to the appended drawings wherein.

PREFERRED EMBODIMENTS OF THE INVENTION

Figure 1:
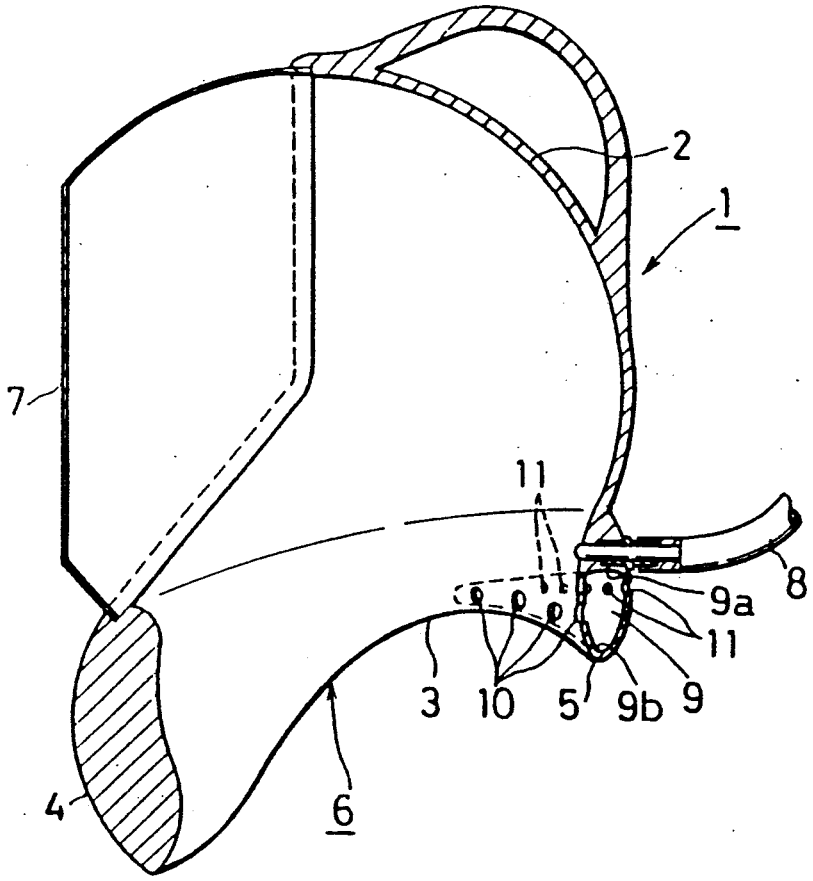
FIG. 1 is a central vertical sectioned side view of one embodiment according to the present invention.
Figure 2:
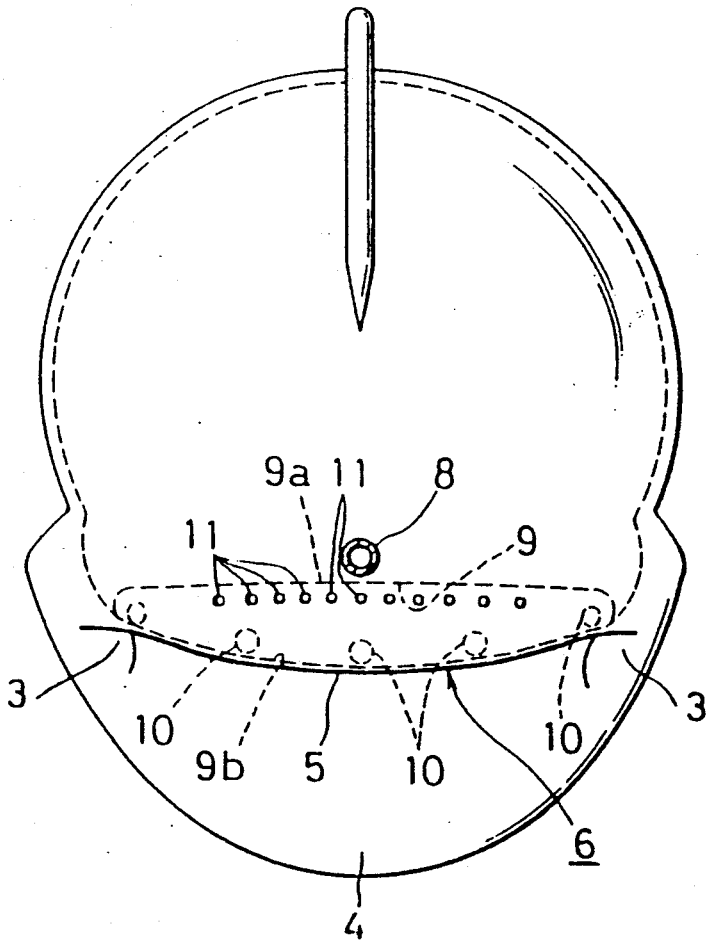
FIG. 2 is a back view thereof.

FIGS. 1 and 2 illustrate an embodiment of this invention. Numeral 1 denotes a diving helmet made of heavy metal or synthetic resin and comprises a head 2 and a body-contacting portion 6 which comprises a shoulder-contacting portion 3, a breast-contacting portion 4 and a neck-contacting portion 5 being relatively thick and heavy. The helmet 1 itself plays a role for the weight in diving.

The face of the helmet 1 comprises a transparent window 7. An air supply tube 8 is connected to the back of the head 2 in the helmet 1 above the neck-contacting portion 5. Air is fed from a ship on the water through the air supply tube 8, so that the head 2 is always filled with fresh air.

The helmet 1 is in use for an underwater walk or sightseeing at relatively small depth of up to ten meters.

In the back of the head 2, there is provided an elongate chamber 9 between the shoulder-contacting portion 3 and the neck-contacting portion 5. A plurality of exhaust guide holes 10 are horizontally formed along the lower edge 9*b* of the chamber 9. A plurality of exhaust holes 11 are formed in the outer wall above the neck-contacting portion 5 of the chamber 9. The exhaust hole 11 has a relatively small diameter, thereby making bubbles smaller and to keep bubble discharge at a certain velocity. The exhaust hole 11 may preferably be positioned closer to the upper edge 9*a* of the chamber 9. The exhaust holes 11 are horizontally aligned, but part or all of them may be out of the alignment. The exhaust guide holes 10 define the water surface within the helmet 1 and may therefore be positioned under the exhaust holes 11 preferably.

Figure 3:
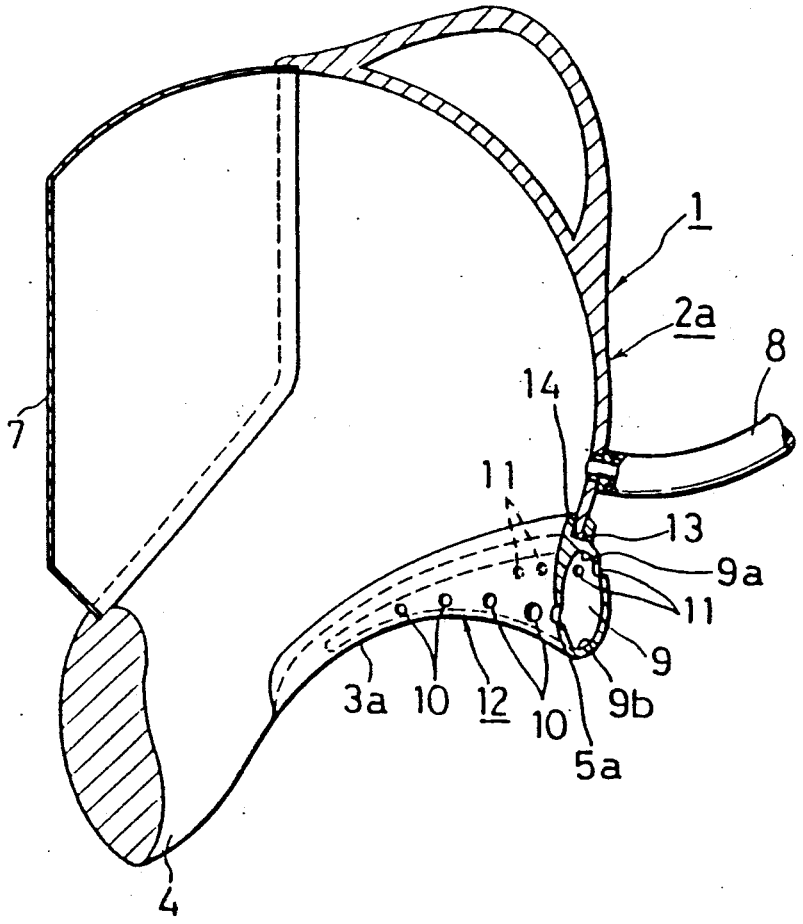
FIG. 3 is a central vertical sectioned side view of another embodiment.

FIG. 3 illustrates another embodiment of this invention. In FIGS. 1 and 2, the chamber 9 is formed in the shoulder-contacting portion 3 and the neck-contacting portion 5 which are integrally molded with the head 2, but it is troublesome to form the chamber 9. In FIG. 3, the contact member 12 is separately molded and, then, is connected to a head 2*a*.

Numeral 13 denotes a protrusion which is provided at the lower end of the back of the head 2*a*, while numeral 14 denotes a groove which is formed at the upper edge of the contact member 11. The lower end of the head 2*a* is inserted into the groove 14 and is supported with the protrusion 13.

In this embodiment, the contact member 12 is made of a soft rubber or vinyl, thereby providing comfortable touch in use and easy manufacturing.

This invention provides stable exhaustion of air and prevents noise or vibration. Bubbles are always discharged through a certain position. Exhausted bubbles never prevent visibility of the user.

The foregoing merely relates to preferred embodiments of the invention, but various changes and modifications may be made by person skilled in the art without departing from the following claims:

What is claimed is:

1. A diving helmet which comprises:
   - a head in which the face comprises a transparent window;
   - a body-contacting portion which is provided under said head, said head and said body-contacting portion being made of rigid material;
   - an air-supply tube which is connected to the back of the head; and
   - an elongate chamber having an inner wall and an outer wall which is formed in said body-contacting portion;
   - the inner wall of said elongate chamber having a plurality of exhaust guide holes, the outer wall of said elongate chamber having a plurality of exhaust holes each of which is smaller than the exhaust guide holes of the inner wall so that bubbles may be discharged into the water through said exhaust guide holes and said exhaust holes.

2. A diving helmet as defined in claim 1 wherein the body-contacting portion is integrally molded with the head.

3. A diving helmet as defined in claim 1 wherein the head and the body-contacting portion are separately molded.

* * * * *